United States Patent [19]

Shiba et al.

[11] 3,969,116

[45] July 13, 1976

[54] SILVER HALIDE PHOTOGRAPHIC SENSITIVE ELEMENT FOR FLASH EXPOSURE

[75] Inventors: Keisuke Shiba; Seiiti Kubodera, both of Minami-ashigara, Japan

[73] Assignee: Fuji Photo Film Co., Ltd., Minami-ashigara, Japan

[22] Filed: Nov. 18, 1974

[21] Appl. No.: 525,036

Related U.S. Application Data

[63] Continuation of Ser. No. 219,047, Jan. 19, 1972, abandoned.

[30] Foreign Application Priority Data

Jan. 19, 1971 Japan ..... 46-1320

[52] U.S. Cl. ..... 96/27 E; 96/27 H; 96/124; 96/126

[51] Int. Cl.[2] ..... G03C 5/04; G03C 1/14

[58] Field of Search ..... 96/124, 126, 137, 27 E, 96/27 H, 45.2

[56] References Cited

UNITED STATES PATENTS

| | | | |
|---|---|---|---|
| 3,183,088 | 5/1965 | Hunt | 96/108 |
| 3,537,858 | 11/1970 | Wise | 96/108 |
| 3,594,172 | 7/1971 | Sincius | 96/45.2 |
| 3,649,289 | 3/1972 | Hiller | 96/126 |
| 3,666,480 | 5/1972 | Shiba et al. | 96/124 |
| 3,713,835 | 1/1973 | Sato et al. | 96/124 |

*Primary Examiner*—J. Travis Brown

*Attorney, Agent, or Firm*—Sughrue, Rothwell, Mion, Zinn & Macpeak

[57] ABSTRACT

A silver halide photographic sensitive element for flash exposure having at least a photographic silver halide emulsion layer which is characterized by containing at least a sensitizing dye having a reduction potential in a range of −0.7 volts – −1.7 volts and at least a sensitizing dye having a reduction potential in a range of −0.7 volts – −1.7 volts and an oxidation potential of larger than a value which is approximately 0.5 volts smaller than the oxidation potential of said sensitizing dye or at least a substantially colorless compound having an oxidation potential of larger than a value which is approximately 0.5 volts smaller than the oxidation potential of said sensitizing dye as the combination having a supersensitization function.

9 Claims, 3 Drawing Figures

SILVER HALIDE PHOTOGRAPHIC SENSITIVE ELEMENT FOR FLASH EXPOSURE

CROSS-REFERENCE TO RELATED APPLICATION

This is a continuation of application Ser. No. 219,047, filed Jan. 19, 1972, now abandoned.

DETAILED EXPLANATION OF INVENTION

The present invention relates to a spectrally sensitized photographic sensitive element and especially to a spectrally sensitized silver halide photographic sensitive element which is suitable for recording by "flash exposure".

With the arrival of the information period, development of a rapid information transmission system has been more and more required and many systems concerning thereto have been developed. For example, there is a press facsimile system by which news manuscript can be rapidly transmitted to remote places, a high speed photo-composing system for producing a form rapidly, a cathode-ray tube display system for recording an output information obtained from computors on a cathode-ray tube as a figure or letter, a high speed photographic recording system by, especially, holography and a printing process of a photomask carried out at a high speed, for example, as photomask microprinting system in preparation of IC.

The sensitive elements used in these systems or processes are exposed to light in a short time of less than a ten thousandth second and especially a millionth second or so with using an exposing device in said systems or processes. As the light source, a xenon lamp, an arc lignt, combination of a high illumination light source such as a high tension mercury lamp and a high speed shutter, a xenon flash light, a flying spot of a fluorescent material of the cathode ray tube and a laser light are used. These are radiant rays which have a high energy in a wave-length range of from ultraviolet rays to visible rays or near infrared rays.

The xenon flash light and the xenon arc light have a high energy over a comparatively wide wave-length range. As the optical system used, there are a condenser lens, a lens, a prism and a reflecting mirror. By these optical systems when the light reaches a sensitive surface of the sensitive element, rays of short wave-length are more absorbed than rays of longer wave-length, and consequently, a ratio of intensity of light having the longer wave-length becomes large. Accordingly, intensity of light having the longer wave-length is relatively high in these optical systems.

For the cathode-ray tube display, radiation of many fluorescent materials is used. As the fluoroscent material. "P-1", "P-11", "P-16", "P-22", "P-22D", "P-24" and "P-31" (all are a trade mark) are used. A wave-length of the luminous light resulting by applying a cathode ray exposure to these fluorescent materials, which imparts the maximum energy is 525mn in P-1, 450nm in P-11, 385nm in P-16. 620nm and 675nm in P-22, 450nm, 525nm and 638nm in P-22D, 510nm in P-24 and approximately 520nm in P-31. As the laser light, a He-Ne laser and a ruby laser are used. The wave length which imparts the maximum energy if 532.8nm and 694.3nm rrespectively.

The high tension mercury lamp consists of three bright lines between 300nm – 370nm and bright lines of 405nm, 436nm, 546nm and 577nm. In the optical system in the above-mentioned systems, bright lines of 546nm and 577nm which are in a longer wave-length range are effective for exposure of the sensitive element.

Accordingly, it is indispensable to apply a spectral sensitization techniques in order to provide a sensitive element which has a high sensitivity to these radiant rays and is suitable for the above-mentioned systems or processes.

As increasing a speed of communication for informations and a density of information capacity, there is required a sensitive element having a high sensitivity for the particle size of silver halide and especially a high spectral sensitivity at exposure for a short time of less than a ten thousandth second.

In this patent specification, "flash exposure" means exposure for a short time suitable for the abovementioned objects and especially of from approximately a thousandth second to a ten millionth second.

The spectral sensitization function of the silver halide photographic emulsion used in the sensitive element is affected by pAg, pH, composition of halogenides, particle size and crystal habit. Especially in case of flash exposure it is greatly affected by these factors. Further, it is greatly affected by a chemical sensitization process or conditions of chemical ripening. It is subjected to the influence of coexisting inorganic metal salts and organic compounds, for example, chemical sensitizers, antifogging agents, stabilizers, color formers, dyes, surface active agents, plasticizers, gelatin, synthetic polymers and hardeners which as used usually at preparation of the photographic sensitive element and deteriorate in many cases. However, a strong spectral sensitization function is induced additionally by selected certain sensitizing dyes when the dyes are used together with the specified colorless organic compounds or other dyes. This is known as the superesensitization, and many inventions about sensitizing dyes having a high spectral sensitization function or selective combinations having the supersensitization function are opened to the public. However, these prior sensitizing dyes or selective combinations having the supersensitization function are found out for "exposing time of longer than approximately a thousandth second".

These inventors have found that the spectral sensitization function depends remarkably upon the exposing time as the well as properties of the sensitizing dye and that the spectral sensitization function of the same dye lowers to less than ½ at an exposing time of shorter than approximately a thousandth second — a hundred thousandth second. Accordingly, it is impossible to estimate on the basis of technical knowledge of the persons skilled in the art of spectral sensitization function and especially super-sensitization function obtained by the flash exposure of dyed which show a spectral sensitization function by exposure of longer than a thousandth second, because any clear view about mechanism of lowering of the spectral sensitivity by flash exposure, that is, reciprocity law failure has not obtained hitherto.

The first object of the present invention is to provide a sensitive element having a high sensitivity used for the above-mentioned "flash exposure" and especially to a photographic sensitive element containing a selective combination of a sensitizing dye having the supersensitization function under the flash exposure and a supersensitizer. The second object of the invention is to provide a sensitive element used widely which gives a high spectral sensitivity not only by the flash exposure but also by exposure for a thousandth second. Another object is to provide a sensitive element which has a high information recording capacity and does not cause softening of gradation. The other object will be understood by description of this patent specification.

As the result of examinations about many dyes and analysis of characteristic and studies about mechanism and function by flash exposure of combinations having the supersensitization function, the above-mentioned objects of the present invention have been attained as follows.

Namely, the objects have been attained by using a photographic emulsin containing a sensitive silver halide having, especially, less than 0.8 microns of particle size which is characterized by containing at least a sensitizing dye having a reduction potential (E red.) in a range of −0.7 volts – −1.7 volts and at least a dye having a reduction potential in a range of −0.7 volts – −1.7 volts and an oxidation potential (E ox.) of higher than a value which is 0.5 volts smaller than that of said sensitizing dye or at least a substantially colorless compound having an oxidation potential of larger than a value which is 0.5 volts smaller than that of said sensitizing dye as a combination having the supersensitization function.

The substantially colorless compound means a substance which does not exhibit absorption substantially in a visible wave length range and in which a spectral sensitization function is not observed in practise. The reduction potential E red. used in the present specification means an electric potential at which the dye is reduced by injection of electrons at a cathode in voltammetry. The value of E red. can be determined exactly by voltammetry. Namely, a volt-ampere characteristic curve is determined in an acetonitrile solution of a dye of $1 \times 10^{-4} - 1 \times 10^{-6}$ moles at 25°C with using tetranormal normal propyl ammonium perchlorate as the supporting electrolyte, a mercury drop electrode and a SCE as the reference electrode. From this curve it is determined as the half-wave electric potential. The value of the oxidation potential E ox, used in the specification means an electric potential at which the dye is oxidized at a anode since electrons of the eye are extracted by the anode. The oxidation potential was determined by the same procedure as in E red. with using sodium perchlorate as the supporting electrolyte. (In more detail, refer to Naturwissenschaften: written by A. Stanienda, vol. 47, pages 353 and 512(1960)).

Detail of this voltammetry is described in New Instrumental Methods in Electrochemistry; written by P. Delahey, (Interscience Publishers Co. 1954) and Polarographic Techniques; written by L. Meites (Interscience Publishers Co. 1965, 2nd edition).

A series of values of E red. and E ox, has allowance of displacement of up to approximately 100 millivolts depending upon the influence of a contact potential difference between liquids, incompleteness of comparison about a liquid resistance of the sample solution, an effect and interruption of anions of the sensitizing dye, and influence of the concentration of the dye. This ensures reproductivity of a value of the electric potential determined by comparison with using 3,3′-diethylthicarbocyanineperchlorate as the standard sample. It can be easily determined by an examination that a sensitizing dye and another sensitizing dye or a substantially colorless compound are a combination having the supersensitization function at exposure of longer than a thousandth second. It can be easily determined by sensitometry by exposing to light for a hundredth second according to the following Example 1.

The sensitivity in the present invention is indicated by a reverse of the sum of the maximum optical density (D max.) and the minimum optical density (D min.) in a photographic characteristic curve (H4D curve). There are many sensitive elements obtained by the present invention, and various kinds of gradation are demanded. The sensitivity defined in the above is suitable as the substitute characteristic of the optical sensitivity of the sensitive element by the present invention. It has been above-mentioned that an object of the present invention is to provide a flash-light sensitive element having a high information capacity. A factor to enhance the information capacity is to reduce the particle size of the photosensitive silver halide and to put in order so as to standardize most particles within a range of the desired size. A distribution of the particle size of the photosensitive silver halide is suitable as the substitute characteristic of the particle size of the silver halide photographic emulsion by the present invention.

The sensitizing dye used in the present invention has a reduction potential in a range of from −0.7 volts to −1.7 volts. It has been known the value of the reduction potential is related to an electron affinity of the dye as a primary relation and becomes an approximate scale of an electron excitation energy level of the dye. It is required the electron excitation energy level of the sensitizing dye used in the present invention is near or somewhat higher than an energy level of an electron conductive zone of the fine silver halide crystals. Especially it is preferable in a range of from, at the most, 0.1 eV lower to 0.7 eV higher. If the energy level of the electron excitation energy level of the sensitizing dye is higher than the energy level of the electron conductive zone of silver halide, namely the value of E red. is negative, the optical sensitization function of the sensitizing dye deteriorates. The other way, if the energy level of the sensitizing dye is lower than that of the electron conductive zone of the silver halide, namely the value of E red. comes near a positive value, the spectral sensitization function of the sensitizing dye becomes poor and especially the sensitivity obtained by flash exposure deteriorates. Accordingly, the value of E red. of the dye is limited between −0.7 volts and − 1.7 volts. The substantially colorless compounds are not spectrally sensitized themselves even though having the supersensitization function, because they do not absorb visible rays.

In a combination of the sensitizing dye used in the present invention and the prior sensitizing dye having a high supersensitization function at an exposing time of longer than, for example, a thousandth second, when the value of the oxidation potential of the desired sensitizing dye is approximately 0.5 volts higher than that of the other sensitizing dye, the spectral sensitization function by light absorption of the sensitizing dye becomes poor as the exposing time shortens. As the result, not only the sensitivity by mere flash exposure deteriorates but the resulting sensitivity depends remarkably upon the exposing time. Namely, the reciprocity law failure of the spectral sensitization is large. This is contrary to the object of the present invention. As shown in the following examples, in a case that a combination which has the supersensitization function of the desired sensitizing dye and another sensitizing dye or a substantially colorless compound satisfies the above-mentioned condition, not only a high sensitivity at flash exposure is obtained but also the supersensitization function is unexpectedly strengthened.

It has been known that styryl dyes or styryl-type compounds have a supersensitization function together with many sensitizing dyes such as 2,2'-cyanine, carbocyanine dyes, homicyanine dyes and pseudocyanine dyes. They are described in, for example, U.S. Patent specification No. 2,313,922, U.S. Patent Specification No. 2,316,268, U.S. Patent Specification No. 2,533,426, U.S. Patent Specification No. 2,852,385, Germany Patent Specification No. 1051116 and British Patent Specification No. 498031. These combinations give a very excellent supersensitization function in a range of the prior exposing time and it is possible to obtain a sensitivity of over several tens times as compared with the sensitivity obtained by using the sensitizing dye solely.

The present inventors carried out the following ecperiment with using a sensitizing dye (A) and a dye for comparison (B) having the super sensitization function at usual exposure.

having 2.0 ± 0.1 microns of thickness.

Sensitometry was carried out according to the following example. The results are shown in FIG. 1. The axis of the ordinate in FIG. 1 represents log It (amount of relative exposure energy = erg/cm$^2$) and the axis of the abscissa represents log I (intensity of relative exposure = erg/cm$^2$ sec.). in FIG. 1, curve 1 is a reciprocity law curve which is obtained by carrying out sensitometry about the sensitive element prepared from the silver iodobromide emulsion with using monochromatic light of 400nm at an exposing time of $1 \times 10^{-2}$ seconds, $1 \times 10^{-3}$ seconds, $1 \times 10^{-4}$ seconds, $1 \times 10^{-5}$ seconds, and $2 \times 10^{-6}$ seconds. Curve 2 is that obtained by the same manner as in curve 1 but used 8cc of the solution of sensitizing dye (A) and exposed with using monochromatic light of 571 nm. Curve 3 is that obtained by the same method but used 8cc of a solution of (A) and 4cc of a solution of the dye for comparison (B) as a mixture and exposed with using monochromatic light of 571 nm. Curve 4 is that obtained by the same method as in the case of 3 but used 8cc of a solution of (B).

Experiment for comparison 1

| | | Ered. | E ox. |
|---|---|---|---|
| (A) | 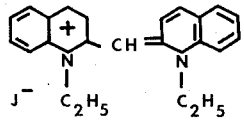 | −1.036volts | 1.041volts |
| (B) | 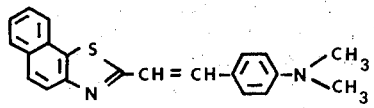 | −1.818 | 0.667 |

According to the following Example 1, a sensitive element was produced by adding a methanol solution of (A) having a concentration of $1 \times 10^{-3}$ mols and a methanol solution of (B) having a concentration of $5 \times 10^{-4}$ mols in the desired amount of 100g of a silver iodobromide emulsion (iodine content: 7.0% by mol; Amount of Ag: 0.51 mols/kg of emulsion; and particle size of silver halide: 0.70 microns) which was prepared by the common method and sensitized chemically by sulfur sensitization and gold sensitization, adding a hardener and a coating assistant thereto, and applying to a transparent triacetate base so as to form a film It is clear from FIG. 1 that the supersensitization function of the dye (B) to the spectral sensitization by the sensitizing dye (A) becomes remarkably weak at flash exposure. The supersensitization function which sensitizes approximately 60 times at exposing for $1 \times 10^{-2}$ seconds is mostly lost at exposing for $2 \times 10^{-6}$ seconds (flash exposure).

Experiment for comparison 2

The same experiments as in Experiment 1 were carried out about the sensitizing dye (C), (D), (E) and (F) in addition to (B). Results are shown in Table 1.

| | | Ered. | Eox. |
|---|---|---|---|
| [C] | 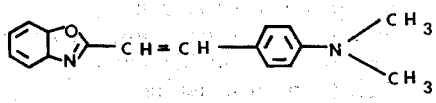 | −237 volts | 0.683 volts |
| [D] | 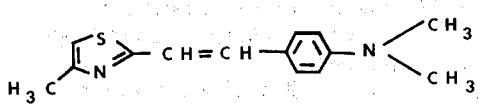 | −259 | 0.592 |
| [E] | 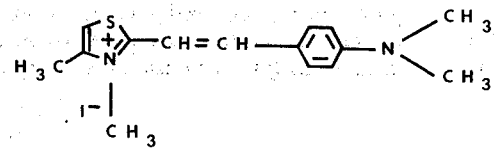 | −1.47 | 0.854 |

-continued (F) 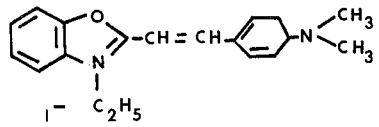

−1.22 0.954

Table 1

| No. | Dye used and (A) mol concentration of 1 × 10⁻ | amount thereof Mol concentration of 1 × 10⁻ | Sensitivity at exposing for 2 × 10⁻ seconds/ × 100 Sensitivity at exposing for 1 × 10⁻ seconds | Relative sensitivity at exposing for 2 × 10⁻ second |
|---|---|---|---|---|
| 1 | (A) 32cc. | — | 63% | 100 |
| 2 | " | (B) 16cc. | 5.9 | 150 |
| 3 | " | (C) " | 7.7 | 100 |
| 4 | " | (D) " | 4.3 | 230 |
| 5 | " | (E) " | 453 | 480 |
| 6 | " | (F) " | 58 | 320 |

It is clear from Table 1 that sensitivities resulting by exposing for $1 \times 10^{-2}$ seconds in Sample No. 2, 3 and 4 in which (B), (C) and (D) are used, respectively, are remarkably low as compared with those resulting by exposing for $1 \times 10^{-2}$ seconds. Namely, reciprocity law failure is very large. Relative sensitivities resulting by exposing for $2 \times 10^{-6}$ seconds in Sample No. 5 and 6 in which (E) and (F) are used, respectively, are higher than the other.

This phenomenon is understood as follows. Each relative potential of styryl dyes (B), (C) and (D) is negative as compared with sensitizing dye (A). It is considered that free electrons generated in the electron conductive energy zone of the silver halide do not move to the dye even though by activation by heat energy, since the reduction potential is more negative than −1.7 volts. Accordingly, it is supposed the spectral sensitization function to the sensitizing dye (A) is caused by a fact that electrons filled in the styryl dyes (B), (C) and (D) play the leading part of the supersensitization function. It is supposed the supersensitization function by such mechanism weakens at a spectral sensitization step by flash exposure. Accordingly, when the reduction potential does not satisfy the condition of the present invention, the oxidation potential has a very great influence. When the reduction potential of the sensitizing dye used satisfies the above-mentioned condition, contribution of the above-mentioned mechanism is promoted if a difference of the oxidation potentials is larger than 0.5 volts. Accordingly, in the spectral sensitization step by flash exposure, the spectral sensitization function weakens. From the above description, it will be understood why the difference between a value of the reduction potential and a value of the oxidation potential is prescribed in the present invention.

In the silver halide emulsion used in the present invention, it is preferable the particle size of the silver halide crystals is 0.04 - approximately 1 micron. It is necessary to change distribution of the particle size according to gradation of the sensitive element.

It is especially preferably a mode where the particle size is less than 0.8 microns. As the silver halide, silver iodide, silver bromide, silver chloride and silver halides having a mixed composition are used preferably. In the following examples, a silver iodobromide emulsion and a silver bromochloride emulsion as shown as typical examples. For the object of the present invention, a reduction sensitization process and a noble metal sensitization method process are applied besides a sulfur sensitization process. Further, it is possible to improve a characteristic of flash exposure by adding Group VIII metal compounds such as hexahalogeno ruthenate, hexahalogeno rhodate, hexahalogeno palladate, hexahalogeno osmate, hexahalogeno iridate, trihalogeno iridate, tetrahalogeno iridate, hexahalogeno platinate and potassium hexahalogeno cobaltate at formation of particles in the silver halide emulsion or at the beginning of or during ripening of the emulsion. These gold compounds or Group VIII metal salts are added in the amount of $10^{-7} - 10^{-3}$ mols per mol of silver. It is preferable to add Group II metal salts such as zinc chloride, cadmium chloride and mercury nitrate in order to control gradation or sensitize. Further, it is possible to increase the spectral sensitivity by adding iodides together with the additives used usually prior to application of a ripened emulsion. In preparation of the color sensitive materials, color formers, image forming dyes, dye developing agents aand development accelerators are used.

In the silver halide emulsion used in the present invention, not only gelatin is used as the protective colloid but also water-soluble synthetic polymers and copolymers can be used together. Further, plasticizers, latex polymers and matting agents can be used together in order to give dimensional stability of the film. The emulsion to which these additives are added is applied to suitable supports, for example, baryta paper, resin laminated paper, synthetic paper, a triacetate film, a polyethylene terephthalate film and other plastic films, a glass plate and resin plates.

The sensitizing dyes and the colorless compounds used in the present invention are added to the silver halide emulsion as an aqueous solution, a methanol solution, a pyridine solution, an acetone solution or a cellosolve solution. These are preferably added together with other additives at a step of chemical ripening or before application. The amount to be added is that used commonly by the persons skilled in the art and preferably $5 \times 10^{-3} - 1 \times 10^{-6}$ mols per mol of silver. The amount to be added of the sensitizing dyes by the present invention depends largely upon the characteristic of flash exposure. In general, an optical amount of the dyes is larger at the case of flash exposure than at the case of the common exposure for $10^{-2}$ seconds, and it sometimes reaches to approximately 2 times. A molar ratio of a sensitizing dye and the other sensitizing dye or a colorless compound changes by a property of the emulsion and required quality of the sensitive material, and is in a range of 1 : 100 – 100 : 1.

In the following, examples of the sensitizing dyes and substantially colorless compounds are shown. But they are not intended to be limitative thereof.

I.

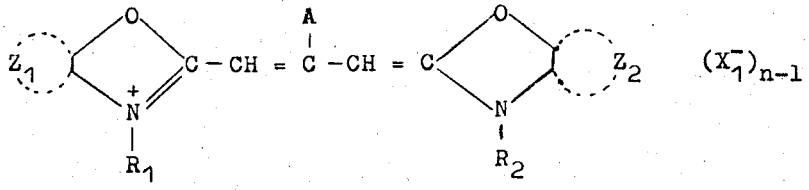

In the formula, $Z_1$ and $Z_2$ each represents a group of atoms necessary to complete a benzene ring which is unsubstituted or substituted by lower alkyl group such as methyl group, halogen atom, phenyl group, hydroxyl group, alkoxy group having 1 – 4 carbon atoms, carboxyl group, alkoxycarbonyl group, alkylsulfamoyl group, alkylcarbamoyl group, acetyl group, cyano group or trifluoromethyl group, or a group of atoms necessary to complete a naphthyl ring. $R_1$ and $R_2$ each represents an alkyl group having 1 – 5 carbon atoms, a substituted alkyl group having a carboxyl group, a substituted alkyl group having a sulfo group such as γ-sulfopropyl group, δ-sulfobutyl group, 2-(3-sulfopropoxy)ethyl group, 2-(2-(3-sulfopropoxy)ethoxy)ethyl group and 2-hydroxy-sulfopropyl group, an allyl group or a substituted alkyl group used in N-substituents of cyanine dyes. A represents a methyl group of ethyl group. $X_1^-$ represents an acid anion used in common cyanine dyes such as iodine ion, bromine ion, p-toluenesulfonic acid ion and perchloric acid ion. *n* represents 1 or 2, but *n* is 1 in the case of having a betaine structure.

II.

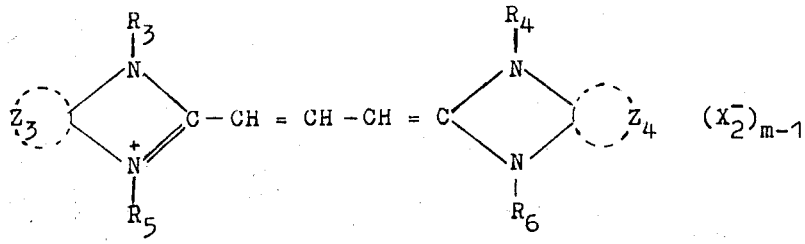

In the formula, $Z_3$ and $Z_4$ each represents a group of atoms necessary to complete a benzene ring which is unsubstituted or substituted by halogen atom, cyano group, trifluoromethyl group, carboxyl group, alkoxycarbonyl group, alkylsulfamoyl group, alkylcarbamoyl group or acetoxy group, or a group of atoms necessary to complete a naphthyl ring. $R_3$ and $R_4$ each represents an alkyl group, a substituted alkyl group used in N-substituents of cyanine cyes, or an allyl group. $R_5$, $R_6$, $X_2^-$ and *m* represent each the same meaning as in $R_1$, $R_2$, $X_1^-$ and *n*. $R_5$ and $R_6$ may form an alkylene group by linking to α-methine group.

III.

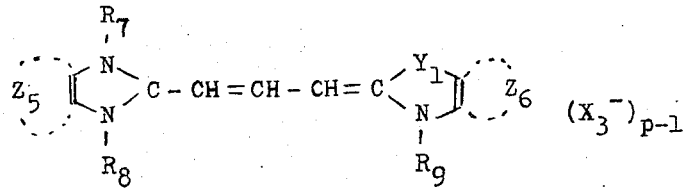

In the formula, $Z_5$ represents the same meaning as in $Z_3$, or $Z_4$. $Z_6$ represents the same meaning as in $Z_1$ or $Z_2$. $R_7$ represents the same meaning as in $R_3$ or $R_4$. $R_8$ and $R_9$ represents the same meaning as in $R_1$ or $R_2$. $X_3^-$ represents the same meaning as in $X_1^-$. *p* represents the same meaning as in *n*. $R_8$ may form an alkylene group by linking to —methine group. Y represents an oxygen atom or

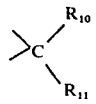

(wherein $R_{10}$ and $R_{11}$ ech represent a methyl group or ethyl group).

IV.

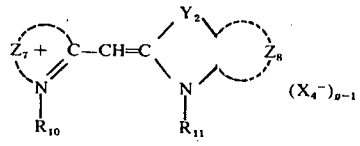

In the formula, $Z_7$ represents a group of atoms necessary to complete a 2-quinoline nucleus which is unsubstituted or substituted by alkyl group having 1 – 5 carbon atoms, alkoxy group or halogen atom. $Z_8$ represents the same meaning as in $Z_1$ or $Z_2$. $Y_2$ represents an oxygen atom, sulfur atom or selenium atom. $R_{10}$ and $R_{11}$ represent each the same meaning as in $R_1$ or $R_2$. $X_4^-$ represents the same meaning as in $X_1^-$. *q* represents the same meaning as in *n*.

V.

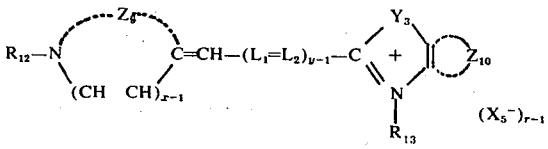

In the formula, $Z_9$ represents a group of atoms necessary to complete a 4l -quinoline nucleus, 2-quinoline nucleus, benzothiazole nucleus, benzoselenazole nucleus, naphthothiazole nucleus, naphthoselenazole nucleus, naphthoxazole nucleus or indolenine nucleus. $L_1$ and $L_2$ represent each a methine group or substituted methine group. 1 represents 1 or 2. *y* represents 1, 2 or 3. $Y_3$ represents an oxygen atom, sulfur atom, selenium atom.

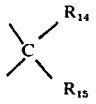

($R_{14}$ and $R_{15}$ each represent a methyl group or ethyl group), -N-$R_{16}$ ($R_{16}$ represents the same meaning as in $R_3$ or $R_4$), or —CH CH—. $Z_{10}$ represents the same meaning as in $Z_1$ or $Z_3$. $R_{12}$ and $R_{13}$ represent the same meaning as in $R_1$ or $R_2$, $X_5^-$ represents the same meaning as in $X_1^-$, and *r* represents the same meaning as in *n*.

VI.

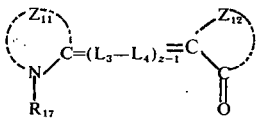

In the formula, $Z_{11}$ represents represents a group of atoms necessary to complete a heterocyclic nucleus used usually in cyanine dyes such as especially thiazole nucleus, thiazoline nucleus, benzothiazole nucleus, oxazole nucleus, oxazoline nucleus, benzoxazole nucleus and tetrazole nucleus. $Z_{12}$ represents a group of atoms necessary to form a keto-heterocyclic nucleus used in merocyanine dyes. $L_3$ and $L_4$ represent each a methine group or methine group substituted by a lower alkyl group such as methyl group and ethyl group, phenyl group, substituted phenyl group, methoxy group or ethoxy group. $R_{17}$ represents the same meaning as in $R_1$ or $R_2$. Z represents 1, 2 or 3.

VII.

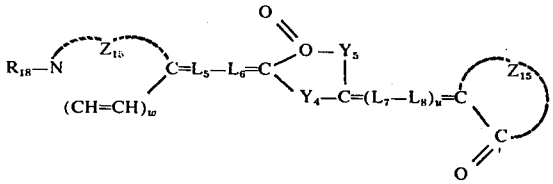

In the formula, $Z_{13}$ represents the same meaning as in $Z_9$, *w* represents the same meaning as in 1, and $R_{18}$ represents the same meaning as in $R_1$ or $R_2$. $L_5$ and $L_6$ represent the same meaning as in $L_3$ or $L_4$. *u* represents 1 or 2. $L_7$ and $L_8$ represents the same meaning as in $L_1$ or $L_2$. $Z_{15}$ represents the same meaning as in $Z_{12}$. $Y_4$ and $Y_5$ represent each an oxygen atom, sulfur atom, selenium atom or =N-$R_{19}$ (wherein $R_{19}$ represents an alkyl group having less than 8 carbon atoms such as methyl, ethyl and propyl group, or allyl group), but at least one thereof is N-$R_{19}$.

VIII.

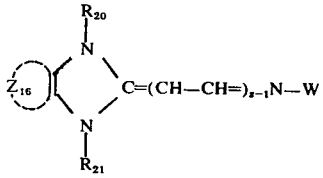

In the formula, $Z_{16}$ represents the same meaning as in $Z_3$ or $Z_4$. $R_{20}$ and $R_{21}$ represent each the same meaning as in $R_3$ and $R_5$. *s* represents 2 or 3. W represents a phenyl group or substituted group.

IX.

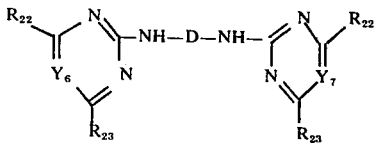

In the formula, $R_{22}$ and $R_{23}$ represent each a halogen atom, hydroxyl group, alkoxyl group, aryloxy group, arylthio group, amino group, alkylamino group or arylamino group. $Y_6$ and $Y_7$ represent each CH or a nitrogen atom. D represents a divalent aromatic group, for example,

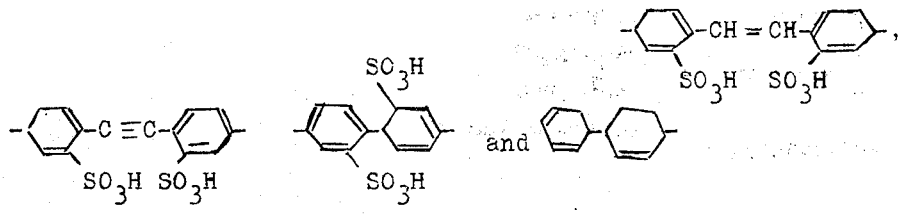

(X)

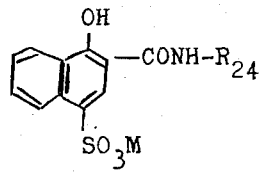

In the formula, $R_{24}$ represents an aliphatic residue having 12 or more carbon atom. M represents an inorganic or organic cation.

Hitherto, it has been found out many combinations which have the supersensitization function in a "usual exposure time" range in the above-mentioned compounds (the substituted alkyl groups used in N-substituents in the common cyanine dyes and the keto-heterocyclic nucleus used in the common merocyanine dyes are described in the following patent specification). For example, they are described in Jap. Pat. Pub. No. 4724/53, Jap. Pat. Pub. No. 4932/68, Jap. Pat. Pub. No. 4933/68, Jap. Pat. Pub. No. 4936/68, Jap. Pat. Pub. No. 4937/68, Jap. Pat. Pub. No. 10773/68, Jap. Pat. Pub. No. 16169/68, Jap. Pat. Pub. No. 22884/68, Jap. Pat. Pub. No. 2530/69, Jap. Pat. Pub. No. 32753/69, Jap. Pat. Pub. No. 22189/70, Jap. Pat. Pub. No. 26470/70, Jap. Pat. Pub. No. 27671/70, Jap. Pat. Pub. No. 25831/70, Jap. Pat. Pub. No. 32741/70, France Pat. No. 1,209,924, France Pat. No. 1,124,042, France Pat. No. 1,405,083, France Pat. No. 1,457,158, France Pat. No. 1,457,159, France Pat. No. 1,457,160, France Pat. No. 1,426,623, France Pat. No. 1,500,218, France Pat. No. 1,563,531, France Pat. No. 1,573,694, France Pat. No. 1,577,734, France Pat. No. 1,578,382, Germany Pat. No. 971,941, Germany Pat. No. 1,013,167, Germany Pat. No. 1,547,641, Germany Pat. No. 1,572,009, Germany Pat. Pub. No. 1,772,956, Germany Pat. Pub. No. 1,806,997, Germany Pat. Pub. No. 1,811,069, Germany Pat. Pub. No. 1,811,542, Germany Pat. Pub. 929,037, Germany Pat. Pub. No. 1,944,751, Germany Pat. Pub. No. 2,000,897, Germany Pat. Pub. No. 2,011,879, Germany Pat. Pub. No. 2,014,896, Germany Pat. Pub. No. 2,017,053, Germany Pat. Pub. No. 2,018,687, Belgium Pat. No. 738,386, Belgium Pat. No. 739,387, Jap. Pat. Application No. Sho 44-48606, Jap. Pat. Application No. Sho 44-58180, Jap. Pat. Application No. Sho 44-86580, Jap. Pat. Application No. Sho 45-28171 and Jap. Pat. Application No. Sho 45-37394. However there is not any clear description concerning the supersensitization at flash exposure as in the present invention. It is entirely unexpected from the above-mentioned many literatures that the object of the present invention is attained when the constituents mentioned in the Claim of the present invention are satisfied.

Figure 1:
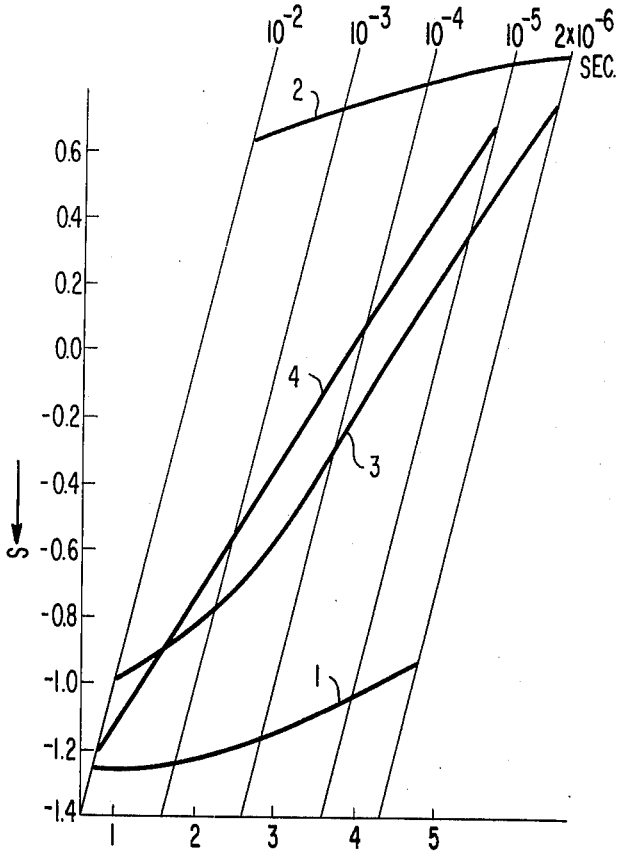
FIG. 1 shows reciprocity law curves for comparison in order to illustrate a characteristic of the silver halide photographic sensitive element of the present invention, in which the axis of the ordinate represents log It (relative exposure energy amount = erg/cm²) and the axis of the abscissa represents log I (relative exposure intensity erg/cm².sec.).

In the following, sensitizing dyes and substantially colorless compounds used in the following examples are shown. But they are not intended to be limitative thereof.

(1)

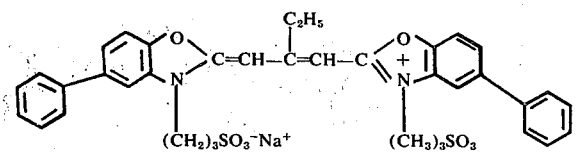

(2)

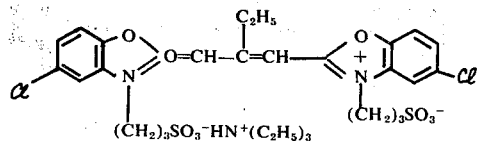

(3)
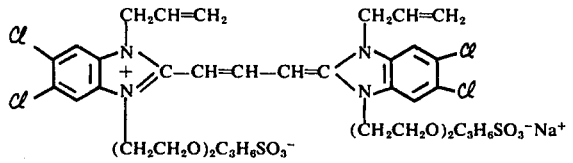
(4)
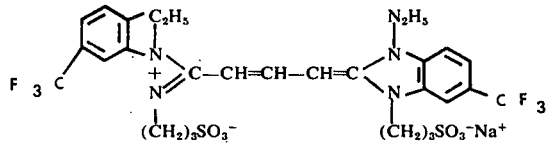
(5)
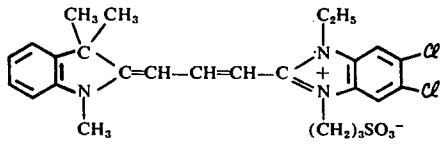
(6)
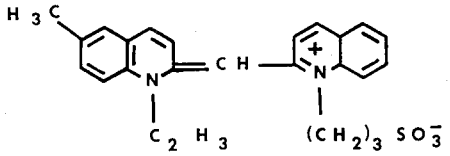
(7)
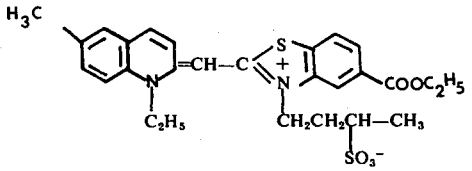
(8)
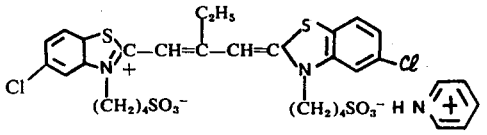
(9)
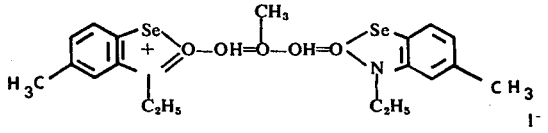
(10)
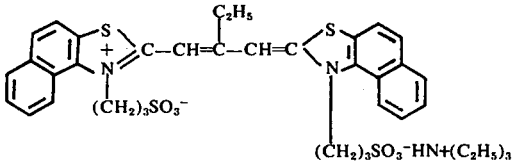
(11)
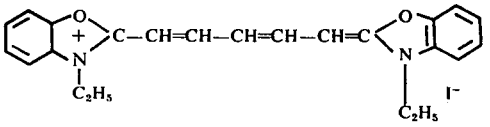

-continued (12)

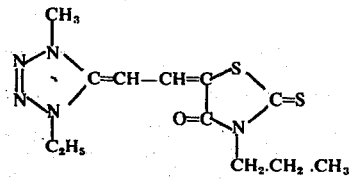

(13)

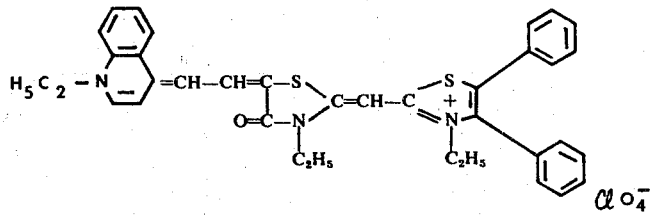

(14)

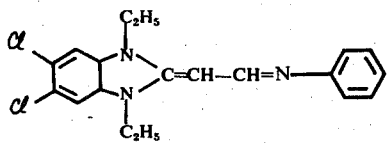

(15)

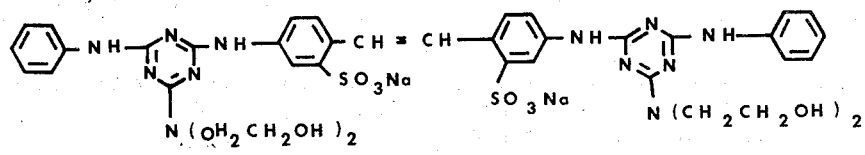

(16)

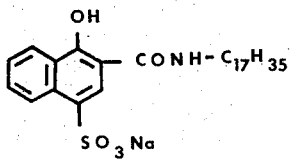

Values of E red. and E ox. of the above-mentioned substances are shown in Table 2.

Table 2

| Substance | E red. volts | E ox. volts |
|---|---|---|
| (1) | −1.274 | 0.878 |
| (2) | −1.231 | 0.903 |
| (3) | −1.492 | 0.519 |
| (4) | −1.581 | 0.514 |
| (5) | −1.306 | 0.818 |
| (6) | −1.144 | 0.973 |
| (7) | −1.215 | 1.131 |
| (8) | −1.168 | 0.785 |
| (9) | −1.086 | 0.753 |
| (10) | −1.211 | 0.591 |
| (11) | −1.010 | 0.647 |
| (12) | −1.679 | 0.518 |
| (13) | −1.041 | 0.422 |
| (14) | −1.563 | 0.956 |
| (15) | −1.884 | >2.0 |

Table 2-continued

| Substance | E red. volts | E ox. volts |
|---|---|---|
| (16) | −1.886 | 1.175 |

EXAMPLE 1

A high speed negative emulsion was obtained by ripening a silver iodobromide emulsion prepared by a usual double jet process (iodine content: 7.0% by mol silver: 0.51 mols/kg emulsion) by a gold sensitization process and a sulfur sensitization process. The mode of the particle size thereof was 0.70 microns.

1kg of the emulsion was taken out and kept at 40°C. It was spectrally sensitized by adding substances shown in Table 3 while stirring. After adding a hardener and an anionic surface active agent as the coating assistant, the emulsion was applied to a transparent triacetate base so as to form a film of 2.0 0.1 microns of thickness and drying to obtain a sample of a sensitive element.

The sample was cut to make strips and sensitometry was carried out. As the sensitometer, a flash sensitometer equiped with an xenon light in which a fixed luminous second was previously established was used (produced by E. G. G. Co.). A monochromatic light was obtained by using an interference filter. The exposing amount thereof was determined with using a physical measurement and a photographic measurement by an actinometer.

After the exposed strips were developed at 20°C for 4 minutes with using the following developer, they were fixed, washed and dried. By determination of the treated strips with using a S-type desensitometer made by Fuji Photo Film Co., a characteristic curve of photography was obtained. An exposing amount necessary to give a density of ⅓ of the sum of the maximum optical density (D max.) and the mininum optical density (D min.) was decided and a relative sensitivity was decided thereby.

| (Composition of developer) | |
|---|---|
| Water | 500 ml |
| Metol | 2 g |
| Anhydrous sodium sulfite | 90 g |
| Hydroquinone | 8 g |
| Sodium carbonate monohydrate | 52.5 g |
| Potassium bromide | 5 g |
| Water to make | 1000 ml |

Results were shown in Table 3. In Table 3, (A) and (B) are values defined as follows.

| | | |
|---|---|---|
| (A): | Sensitivity resulting by exposing for 2 | $10^{-6}$seconds ×100 |
| | Sensitivity resulting by exposing for 1 | $10^{-2}$seconds |
| (B): | Relative sensitivity resulting by exposing for seconds. | $2\times10^{-6}$ |

Table 3

| Ex. No: | Substance used | (Mol concentration) ml | | | (Mol concentration) ml | | Wave length of exposure | (A) | (B) | FIG. | Drawing |
|---|---|---|---|---|---|---|---|---|---|---|---|
| 1 | [1] | ($1\times10^{-3}$) | 40 | | — | | 550 | 56 | 100 | 0.06 | FIG. 2 curve 5 |
| | | — | | [3] | ($5\times10^{-4}$) | 40 | 571 | 37 | 107 | 0.06 | FIG. 2 curve 6 |
| | [1] | | 40 | [3] | | 40 | 550 | 66 | 252 | 0.06 | FIG. 2 curve 7 |
| | | | | | | | 571 | 72 | 159 | | FIG. 2 curve 8 |
| 2 | [2] | ($1\times10^{-3}$) | 40 | | — | | 550 | 44 | 96 | 0.06 | |
| | [2] | | 40 | [3] | | 40 | 571 | 53 | 105 | 0.06 | |
| | [2] | | 80 | [3] | | 40 | 571 | 60 | 232 | 0.06 | |
| 3 | [7] | ($1\times10^{-3}$) | 160 | | — | | 525 | 34 | 23 | 0.06 | |
| comparison | | — | | [3] | | 80 | 571 | 47 | 100 | 0.06 | |
| | [7] | | 160 | [3] | | 80 | 571 | 28 | 84 | 0.06 | |
| | | | | | | | 525 | 32 | 63 | 0.06 | |
| 4 | [5] | ($1\times10^{-3}$) | 40 | | — | | 550 | 53 | 63 | 0.06 | |
| | | — | | [4] | ($5\times10^{-4}$) | 80 | 562 | 51 | 178 | 0.06 | |
| | [5] | | 40 | [4] | | 80 | 550 | 68 | 200 | 0.06 | |
| 5 | [8] | ($1\times10^{-3}$) | 40 | | — | | 660 | 36 | 100 | 0.06 | |
| | | — | | [10] | ($5\times10^{-4}$) | 40 | 680 | 19 | 224 | 0.06 | |
| | [8] | | 40 | [10] | | 40 | 660 | 48 | 425 | 0.06 | |
| 6 | [8] | ($1\times10^{-3}$) | 40 | | — | | 660 | 40 | 100 | 0.06 | |
| | | — | | [9] | ($1\times10^{-3}$) | 20 | 660 | 15 | 26 | 0.06 | |
| | [8] | | 40 | [9] | | 20 | 660 | 56 | 115 | 0.06 | |
| 7 | [8] | | 40 | [14] | ($1\times 10^{-3}$) | 20 | 660 | 33 | 126 | 0.06 | |
| 8 | [6] | ($1\times10^{-3}$) | 80 | | — | | 571 | 48 | 30 | 0.06 | |
| | [6] | | 80 | [10] | | 40 | 571 | 56 | 320 | 0.06 | |
| | | | | | | | 680 | 48 | 360 | 0.06 | |

Figure 2:
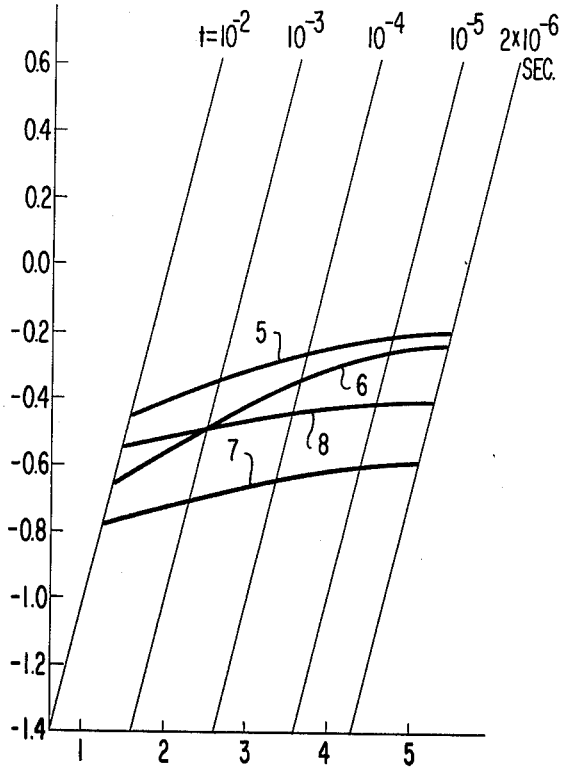
FIG. 2 shows reciprocity law curves of the sensitive element which supersensitized by the present invention and the sensitive elements which contain each dye respectively, in which the axis of the ordinate and the axis of the abscissa represent the same meaning.
Figure 3:
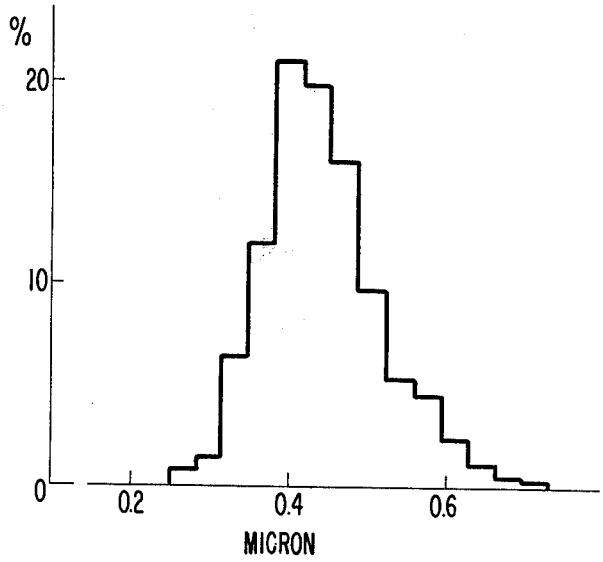
FIG. 3 shows a distribution curve of particle size of the silver halide photographic emulsion used in Example 2, in which the axis of the ordinate represents % relative frequency and the axis of the abscissa represents particle size.

Reciprocity law curve resulting by No. 1 are shown as 5, 6, 7 and 8 in FIG. 2.

EXAMPLE 2

A silver iodobromochloride emulsion prepared by the common method (iodine content: 1% by mol, bromine content: 17% by mol, silver amount: 0.13 mols/kg of emulsion) was treated by a gold sensitization process and a sulfur sensitization process to obtain a high speed silver iodobromochloride emulsion. The mode of the particle size thereof was 0.40 microns.

A sample of the sensitive element was obtained by the same procedure as in Example 1.

Sensitometry was carried out by the same treatment as in Example 1, but development was carried out at 20°C for 4 minutes with using a developer which was prepared by diluting 2 times the following composition. Results are shown in Table 4.

It will be understood from Table 3 that the mode thereof is 0.40 microns.

| (Composition of developer) | |
|---|---|
| Water | 500 ml |
| Metol | 2 g |
| Anhydrous sodium sulfite | 40 g |
| Hydroquinone | 4 g |
| Sodium carbonate monohydrate | 28 g |
| Potassium bromide | 1 g |
| Water to make | 1000 ml. |

Table 4

| Ex. No. | Substance used (mol concentration) ml. | | ml. | Wave length of exposure nm | (A) | (B) | Fog |
|---|---|---|---|---|---|---|---|
| 9 | (13) ($5\times10^{-4}$) | 40 | — | 700 | 25 | 100 | 0.12 |
| | (13) | 40 | (16) (5% by weight) 200 | 700 | 50 | 282 | 0.08 |
| 10 | (13) | 40 | (15) (0.5% by weight) 40 | 700 | 33 | 316 | 0.07 |
| 11 | (9) ($1\times10^{-3}$) | 40 | — | 622 | 26 | 220 | 0.08 |
| | " | | — | 651 | 30 | 115 | " |
| | — | | (12) (mol concentration of $1\times10^{-3}$) 80 | 525 | 58 | 56 | 0.07 |
| | (9) | 40 | (12) 80 | 622 | 36 | 250 | 0.08 |
| | " | | " | 651 | 40 | 300 | " |
| 12 | (11) ($1\times10^{-2}$) | 40 | — | 622 | 56 | 43 | 0.09 |
| | (11) | 40 | (15) (0.5% by weight) 40 | 622 | 40 | 92 | 0.08 |

It will be understood from the above-mentioned Tables that the fog does not substantially increase in the sensitive element of the present invention as compared with that known hitherto and the spectral sensitivity remarkably increases at flash exposure.

Preferable embodiments of the present invention are described in the following.

1. A silver halide photographic emulsion which contains a combination of a gold salt and at least a VIII group metal salt.

2. A silver halide photographic sensitive emulsion which contains a combination of at least a sensitizing dye represented by the formula (I) above-mentioned

I.

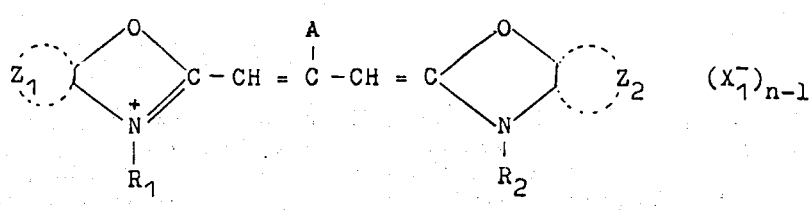

and at least a sensitizing dye represented by the formula (II).

3. A silver halide photographic sensitive emulsion which contains a combination of at least two sensitizing dyes represented by the formula (V) above-mentioned so as to have the supersensitization function.

4. A silver halide photographic sensitive emulsion which contains a combination of at least a sensitizing dye represented by the formula (V) as above-mentioned and at least a sensitizing dye represented by the formula (IV) as above-mentioned.

5. A silver halide photographic sensitive element which contains a combination of at least a sensitizing dye represented by the formula (VI) as above-mentioned and at least a sensitizing dye represented by the formula (V) as above-mentioned.

6. A silver halide photographic sensitive emulsion in which a mode of particle size of silver halide particles is smaller than 0.8 microns.

7. A silver halide photographic sensitive emulsion in which a mode of particle size of silver halide particles is smaller than 0.5 microns.

8. A sensitive element described in the examples above-mentioned.

What is claimed is:

1. A photographic process which comprises exposing to a flash light a silver halide photographic light-sensitive element having at least a photographic silver halide emulsion layer which is characterized by containing at least a sensitizing dye I and at least a sensitizing dye II as a combination having a supersensitization function, for a time shorter than $1\times10^{-3}$ seconds, and developing said photographic element, said sensitizing dyes I and II being selected from dyes of the structural formula below wherein $Z_1$ and $Z_2$ each represents a group of atoms necessary to complete a benzene ring, which is unsubstituted or substituted with a member selected from the group consisting of a lower alkyl group, a halogen atom, a phenyl group, a hydroxyl group, an alkoxy group of from 1 to 4 carbon atoms, a carboxyl group, an alkoxycarbonyl group, an alkyl sulfamoyl group, an alkylcarbamoyl group, an acetyl group, a cyano group and a trifluoromethyl group, or a group of atoms necessary to complete a naphthyl ring; wherein $R_1$ and $R_2$ each represents a member selected from the group consisting of an alkyl group of from 1 to 5 carbon atoms, a substituted alkyl group having a carboxyl group, a substituted alkyl group having a sulfo group, an allyl group, and a substituted alkyl group, commonly employed as a N-substituent of a conventional cyanine dye; wherein A represents a member selected from the group consisting of a methyl group and an ethyl group; wherein $X_1^-$ represents an acid anion employed in common cyanine dyes; and wherein $n$ represents an integer of 1 to 2, with the proviso that $n$ is 1 in the case where said dye contains a betaine moiety;

II.

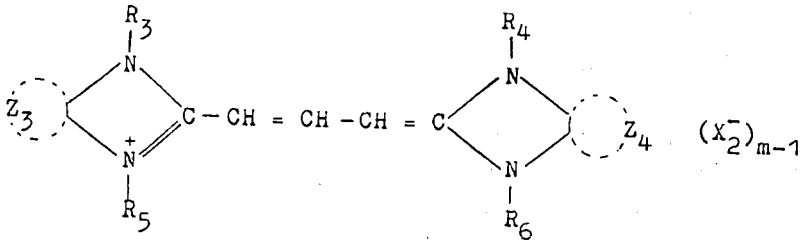

wherein $Z_3$ and $Z_4$ each represents a group of atoms necessary to complete a benzene ring, which is unsubstituted or substituted with a member selected from the group consisting of a halogen atom, a cyano group, a trifluoromethyl group, a carboxyl group, an alkoxycarbonyl group, an alkyl sulfamoyl group, an alkyl carbamoyl group and an acetoxy group, or a group of atoms necessary to complete a naphthyl ring; wherein $R_3$ and $R_4$ each represents a member selected from the group consisting of an alkyl group, an allyl group, and a substituted alkyl group commonly employed as a N-substituent of a cyanine dye; wherein $R_5$, $R_6$, $X_2^-$, and *m*, respectively, each are defined in the same manner as $R_1$, $R_2$, $X_1^-$ and *n* in the formula (I) above, said $R_5$ and said $R_6$ further capable of forming an alkylene bridge through linkage to the alpha-methine group of said dye of formula (II).

2. The process of claim 1 which further contains a combination of a gold salt and at least one VIII group metal salt.

3. The process of claim 1 in which the particle size of the silver halide particles is smaller than 0.8 microns.

4. The process of claim 1 wherein the particle size of the silver halide particles is smaller than 0.5 microns.

5. The process of claim 1 containing a supersensitizing combination of a sensitizing dye of the formula

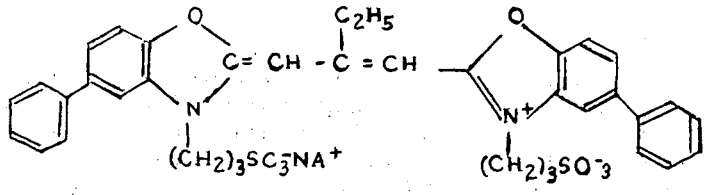

a sensitizing dye of the formula

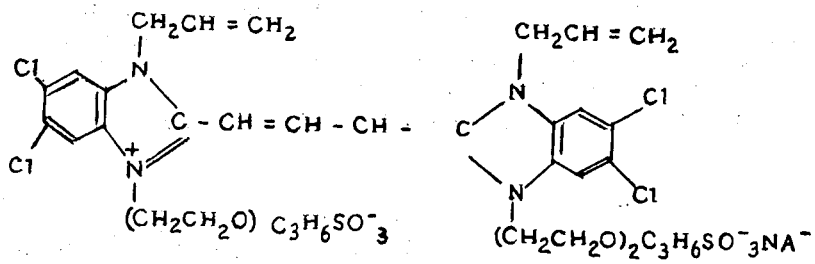

6. The process of claim 1, wherein the substituted alkyl group having a sulfo group is selected from a sulfoalkyl group, a sulfoalkoxy alkyl group, a sulfoalkoxy-alkoxyalkyl group and a hydroxy and sulfo-substituted alkyl group.

7. The process of claim 1, wherein the substituted alkyl group having a sulfo group is selected from γ-sulfopropyl group, δ-sulfobutyl group, 2-(3sulfo-propoxy) ethyl group, 2-[2-(3-sulfopropoxy)ethoxy] ethyl group and 2-hydroxy-sulfopropyl group.

8. A photographic process as claimed in claim 1 wherein the photographic element is exposed to a flash light for a time of at most $1\times10^{-5}$ seconds.

9. A photographic process as claims in claim 1, wherein the dye combination comprises a sensitizing dye selected from the group consisting of

[1]

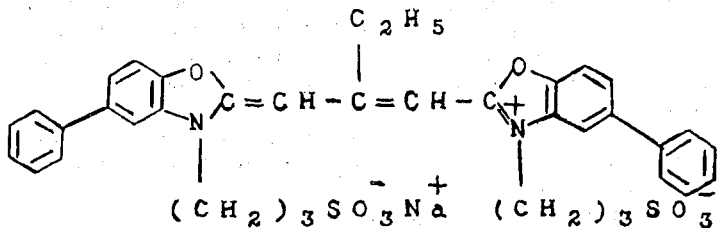

and

[2]
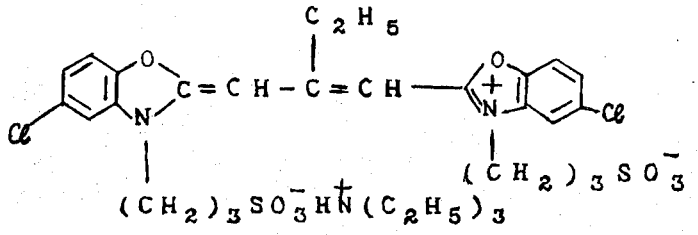
and a sensitizing dye selected from the group consisting and
[4]
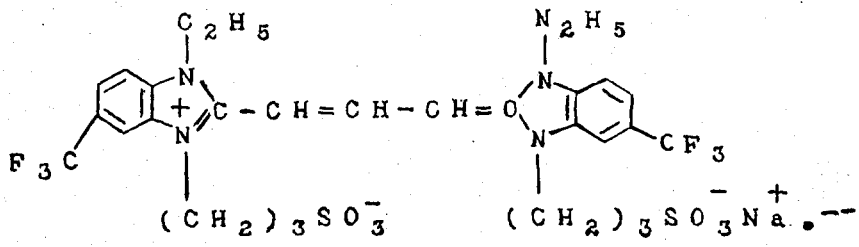
of
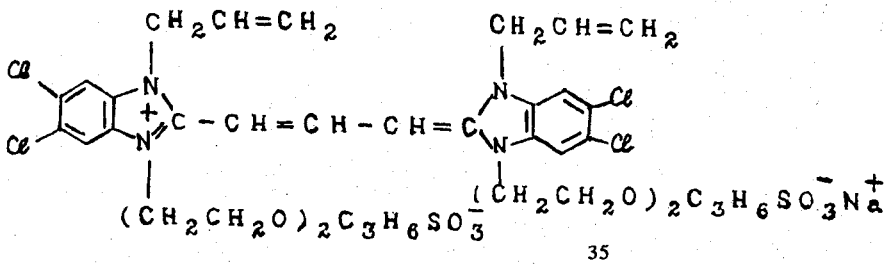
* * * * *